United States Patent [19]

Viragh

[11] 4,180,094

[45] Dec. 25, 1979

[54] DRAIN COVER ASSEMBLY

[76] Inventor: Steve Viragh, 11716 Cromwell, Cleveland, Ohio 44120

[21] Appl. No.: 909,113

[22] Filed: May 24, 1978

[51] Int. Cl.[2] ..... E03F 5/12; A47K 1/14

[52] U.S. Cl. ..... 137/362; 137/357; 4/295

[58] Field of Search ..... 137/356, 357, 362; 210/163, 164, 165, 166; 4/255, 287, 295

[56] References Cited

U.S. PATENT DOCUMENTS

| | | | |
|---|---|---|---|
| 1,577,039 | 3/1926 | Lafin | 137/593 |
| 2,131,240 | 9/1938 | Tucker | 137/152 |
| 2,246,012 | 6/1941 | Sanders | 210/163 |
| 2,517,195 | 8/1950 | Gaspar | 210/163 |
| 2,773,619 | 12/1956 | Moeller | 4/295 |
| 2,816,574 | 12/1957 | Bots | 137/593 |
| 2,892,467 | 6/1959 | Weisman et al. | 137/362 |
| 2,928,419 | 3/1960 | Kruse | 137/593 |
| 2,970,605 | 2/1961 | Sargent | 137/362 |
| 3,093,154 | 6/1963 | Nielsen | 137/362 |
| 4,035,297 | 7/1977 | Aldridge et al. | 137/362 |
| 4,074,684 | 2/1978 | Biesel | 137/362 |
| 4,112,527 | 9/1978 | Giubilo | 4/295 |

*Primary Examiner*—Martin P. Schwadron
*Assistant Examiner*—A. Michael Chambers

[57] ABSTRACT

A drain cover assembly 10 for venting a drain 14 located below grade to the ground level is disclosed. The assembly includes a hollow frustro-conical drain cover 12 which opens downward to cover the top of a floor drain 14. The lower annular end surface 64 of the drain cover 12 is provided with a rubber seal to engage the top of the drain 14. The drain cover is held in place by a jack screw which extends between a recess 46 in the top of the drain cover and the structure above, typically the ceiling of a basement. A flexible conduit is connected with the drain cover and extends upward through a window 20 or other opening to the ground level. When water from a sewer system backs up through the drain 14, hydrostatic pressure forces the water through the flexible conduit 18 to a location remote from the building in which the drain is located.

4 Claims, 6 Drawing Figures

DRAIN COVER ASSEMBLY

BACKGROUND OF THE INVENTION

The present invention relates to a device for preventing overflow from a drain.

During rain storms or other extraordinary circumstances a drainage system may become overloaded, and water from higher ground may be forced up out of drains located in lower areas. This is particularly true with drains which are located below grade, as are drains in the basements of buildings. These drains are especially vulnerable because their location below grade may place them on very nearly the same level as a sewer main to which the drain is connected. A small back pressure in the main can cause water to back up through the drain and flood the basement of the building in which it is located, causing damage to the property.

There have been prior devices adapted to seal drains to prevent back flows. Some of these have provided stand pipes which may be rapidly connected to the drain so that back up water will rise in the pipe without flooding the basement. These devices have the disadvantage that if the water level rises above the top of the stand pipe, water then flows into the basement.

SUMMARY OF THE INVENTION

The present invention provides a new and improved drain cover assembly. The drain cover assembly is compact, portable, and easily intalled over a drain to prevent water from backing up into a building in which the drain is located.

Water which backs up a drain covered by a drain cover assembly of the present invention enters a conduit which may extend out a nearby window. The water is directed through the conduit away from the building in which the drain is located.

The new and improved drain cover assembly of the present invention includes a hollow frustro-conical drain cover. The larger diameter end portion is open and may be placed over an upward opening drain. The drain cover is held in sealing engagement with the drain by a vertically extending jackscrew which abuts the circular top of the drain cover and the ceiling of building in which the drain is located.

BRIEF DESCRIPTION OF THE DRAWINGS

These and other objects and features of the present invention will become more apparent upon a reading of the following specification taken together with the accompanying drawings in which.

DESCRIPTION OF ONE PREFERRED EMBODIMENT

Figure 1:
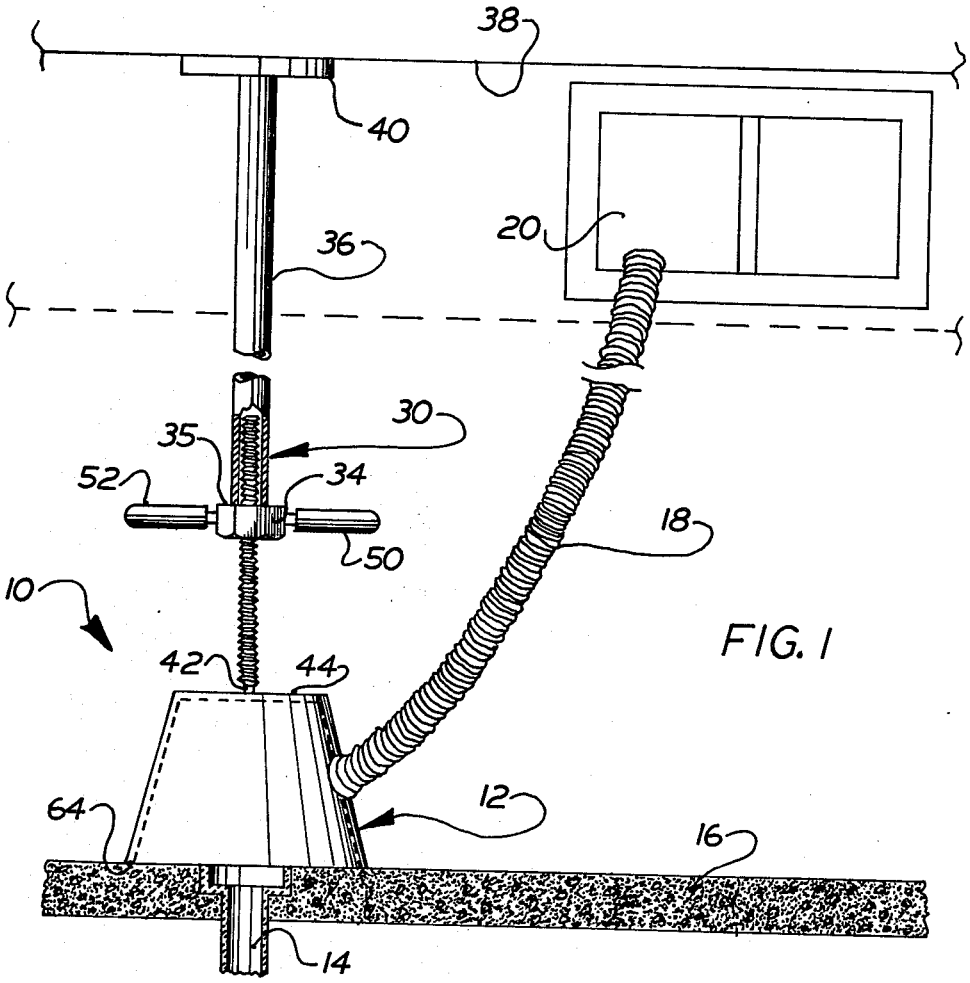
FIG. 1 is a pictorial illustration of a drain cover assembly embodying the present invention and showing a drain cover in place over an upwardly opening drain.

The drain cover assembly 10 of the present invention is illustrated in FIG. 1. The drain cover 12 is placed over a drain 14 in the floor 16 to prevent water backing up in the sewage system from flooding into the building in which the drain 14 is located. A conduit 18 is connected with the drain cover 12 and conducts backed up water from the drain 14 out the window 20 or to another suitable location.

The drain cover 12 is held in sealing engagement with the floor 16 surrounding the drain 14 by a vertically extending jackscrew 30. The jackscrew 30 includes a threaded rod 32, a manually rotatable nut 34 and a tubular post 36 which telescopically receives the threaded rod. The nut 34 engages the threads on the threaded rod 32, and the upper surface 35 (as viewed in FIG. 1) of the nut abuts the lower end of the post 36. The upper end of the post 36 abuts the ceiling 38 of the structure in which the drain 14 is located. A rigid load spreading plate is provided between the upper end of the post 36 and the ceiling 38 to prevent damage to the ceiling. The plate 40 may have a socket 41 (FIG. 5) for receiving the end of the post 36.

Figure 2:
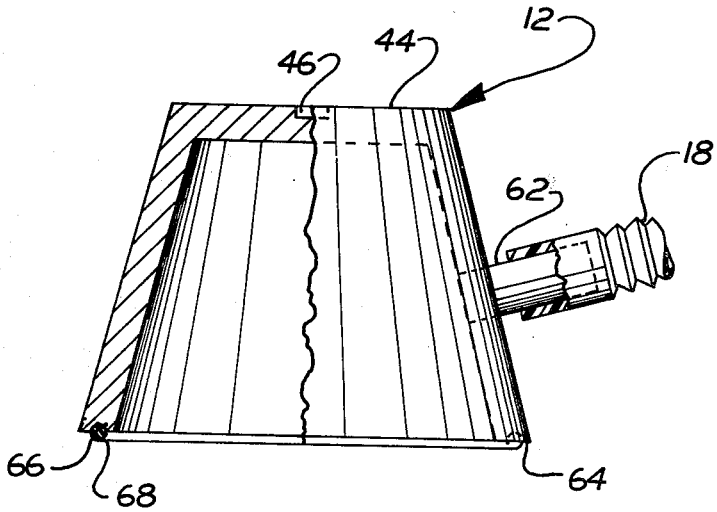
FIG. 2 is a side view of the drain cover shown in FIG. 1 illustrating a seal ring on the bottom of the drain cover and an outlet from the drain cover connected with a flexible conduit.
Figure 3:
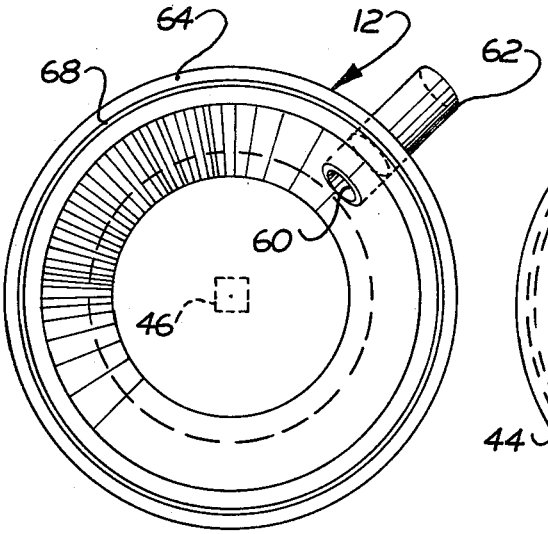
FIG. 3 is a bottom view of the drain cover of FIG. 2 further illustrating the seal ring and outlet of FIG. 2.
Figure 4:
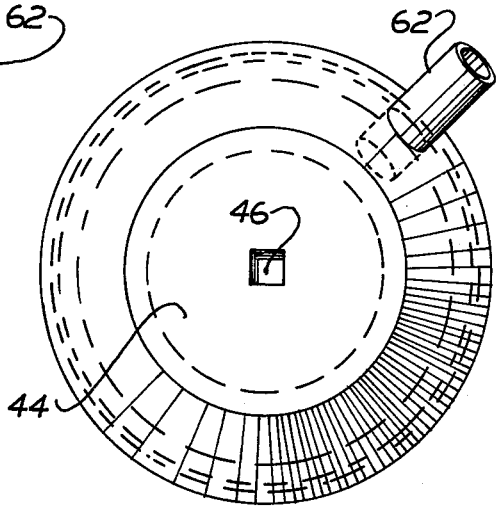
FIG. 4 is a top view of the drain cover of FIG. 1 showing a square recess in the top of the drain cover.

The lower end 42 of the threaded rod 32 bears against the top 44 of the drain cover 12. The lower end 42 of the threaded rod 32 has a square cross section which fits into a square recess 46 (FIGS. 2 and 4) in the top 44 of the drain cover 12. When the nut 35 is rotated the square recess 46 prevents the threaded rod 32 from rotating relative to drain cover 12.

The post 36 may be a single hollow tube made of metal as illustrated in FIG. 1. Such a post 36 is cut to the approximate proper length which depends on the distance between the floor 16 and the ceiling 38.

Figure 5:
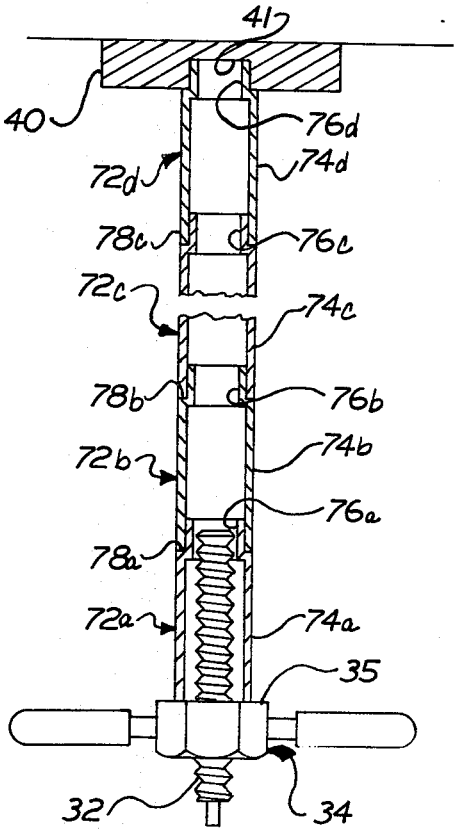
FIG. 5 is a view of a jackscrew of FIG. 1 having a squared end portion to fit into the square recess shown in FIG. 4, a manually rotatable nut and a segmented tube.

However, the post **36*a* may also be segmented as shown in FIG. 5. The sections 72*a*, 72*b*, and 72*c* are of the same length, and each includes a tubular main body portion 74*a*, 74*b*, and 74*c* and a reduced cross section neck 76*a*, 76*b*, and 76*c* connected with the main body portion by a radially extending shoulder 78*a*, 78*b*, and 78*c*. The sections 72*a*, 72*b*, and 72*c*** are stacked one on top of the other with the lower end of the main body portion of each resting on the shoulder of the section below, and the neck of the lower section inside the main body of the succeeding section.

The segmented post **36*a* is easier to store than a unitary post 36. In addition, the segmented post may be easily adapted to ceilings of different heights. The threaded rod 32 is longer than any one of the post segments 72*a*, 72*b*, 72*c*, and 72*d*. This makes the length of the jackscrew 30** continuously adjustable in length to accommodate any ceiling height.

Regardless of whether unitary post 36 (FIG. 1) or segmented post **36*a* (FIG. 5) is used, the operation of the jackscrew 30 (FIG. 1) remains the same. The post 36 telescopically receives the threaded rod to an extent regulated by the position of the nut 34 on the threaded rod. The nut 34 (FIG. 1) includes a pair of radially extending handles 50 and 52. The handles 50 and 52 facilitate manual rotation of the nut 34. Rotating the nut 34 in one direction causes it to descend on the threaded rod 32 and loosens the jackscrew 30. Rotating the nut 34 in the opposite direction causes the nut to rise on the threaded rod, and lengthens the jackscrew 30 to force the drain cover 12 tightly against the floor 16**.

The metal drain cover 12 (FIG. 2) is frustro-conical in shape and has a hollow interior. An outlet 60 extends through the side wall where a metal nipple 62 is connected. The nipple 62 is connected with the drain cover 12 by any suitable means, as by welding. The nipple 62 facilitates connecting the flexible conduit 15 to the drain 12.

The annular bottom surface 64 (FIG. 1) of the drain cover 12 is adapted to seal tightly against the floor 16 around the drain 14. The surface (FIG. 2) is provided with an annular recess 66 having a semicircular cross section. The recess is provided to receive a seal 68 which may be conveniently formed of a flexible material such as a rubber o-ring. When the drain cover 12 is in place, the o-ring 68 provides a fluid tight seal.

Figure 6:
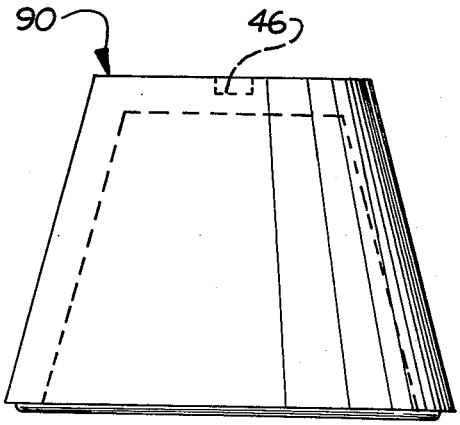
FIG. 6 is a view of a drain cover not having an outlet for connection with a flexible conduit.

In the event that the building in which the drain 14 is located is provided with more than one drain, the use of a single drain cover assembly 10 will not prevent basement flooding. Water which cannot back out of one drain will simply back out of another. To prevent such an occurrence a second type of drain cap 90 is provided as illustrated in FIG. 6.

The cap 90 is similar to the cap 12 illustrated in FIG. 1, except that the drain cover 90 (FIG. 6) is adapted to provide a fluid tight seal over a drain, and to prevent any water escaping from the drain so covered. To this end the drain cover 90 is manufactured without any opening which would permit water to escape.

The main drain in the basement may then be fitted with a drain cover 12 such as is shown in FIG. 1. The conduit is placed out a window to direct flood water away from the building. Other drains in the basement are sealed with drain covers of the type illustrated in FIG. 6 to prevent a backflow through them.

Thus it is clear that the present invention provides a new and improved drain cover assembly 10. The drain cover assembly 10 is compact, portable, and easily intalled over a drain 14 to prevent water from backing up into a building in which the drain is located.

Water which backs up a drain 14 covered by a drain cover 12 of the present invention enters a conduit 18 which may extend out a nearby window 20. The water is directed through the conduit 18 away from the building in which the drain is located.

The new and improved drain cover assembly 10 of the present invention includes a hollow frustro-conical drain cover 12. The larger diameter end portion is open and may be placed over an upward opening drain 14. The drain cover is held in sealing engagement with the drain by a vertically extending jackscrew 30 which abuts the circular top of the drain cover and the ceiling 38 of building in which the drain is located.

I claim:

1. A drain cover assembly for use in venting a below grade floor drain under a building structure, said assembly comprising a hollow drain cap having a bottom rim dimensioned to cover the drain, resilient seal means for disposition between said rim and the floor surrounding the drain, a nipple extending from said cap and communicating with the hollow interior of said cap, flexible conduit means coupled to said nipple for conducting water from the hollow interior of said cap to a remote location, a jack screw having a threaded arm telescopically movable in a tubular shaft, a nut coacting between the one end of the shaft and the threaded arm for telescopically moving the arm relative to the tubular shaft, and a load distributing plate at the free end of the shaft for engagement with the overlying building structure, the free end of the threaded arm being disposed in abutting engagement with the top of said cap.

2. A drain cover assembly for use in venting a below grade floor drain under a building structure, said assembly comprising a hollow frustro-conical drain cap having an annular rim, conical sidewalls, and a planar circular top, and dimensioned to cover the drain, an axially extending recess in the annular rim, a resilient o-ring seal disposed in the recess and projecting for a portion of its axial dimension from the recess for sealing engagement with the floor surrounding the drain, a nipple extending from the conical sidewall of the cap and communicating with the hollow interior of the cap, a flexible water conduit coupled to the nipple for conducting water from the hollow interior of the cap to a remote location, a centrally located axially extending recess in the exterior surface of the circular top, a jackscrew having a threaded arm telescopically movable in a tubular shaft, a nut coating between one end of the shaft and the threaded arm for telescopically moving the arm relative to the tube, and a load distributing plate at the free end of the shaft for engagement with the overlying building structure, the threaded arm being adapted to be received at its free end in the recess in the circular cap.

3. An assembly as set forth in claim 2 wherein said cap includes surface means defining a recess in the top of said cap and said jackscrew includes one end portion adapted to be non-rotatably received in said recess.

4. An assembly as set forth in claim 2 wherein said jackscrew includes a plurality of tubular sections disposed in a vertical stacked arrangement, each of said sections having an upper end portion adapted to be received by the lower end portion of the section above it.

* * * * *